US007722805B2

(12) United States Patent
Hao et al.

(10) Patent No.: US 7,722,805 B2
(45) Date of Patent: May 25, 2010

(54) TITANIUM ALLOY WITH EXTRA-LOW MODULUS AND SUPERELASTICITY AND ITS PRODUCING METHOD AND PROCESSING THEREOF

(75) Inventors: Yulin Hao, Liaoning (CN); Shujun Li, Liaoning (CN); Rui Yang, Liaoning (CN)

(73) Assignee: Institute of Metal Research Chinese Academy of Sciences, Shenyang (CN)

( * ) Notice: Subject to any disclaimer, the term of this patent is extended or adjusted under 35 U.S.C. 154(b) by 265 days.

(21) Appl. No.: 10/582,233

(22) PCT Filed: Nov. 25, 2004

(86) PCT No.: PCT/CN2004/001352

§ 371 (c)(1),
(2), (4) Date: Jun. 9, 2006

(87) PCT Pub. No.: WO2005/064026

PCT Pub. Date: Jul. 14, 2005

(65) Prior Publication Data

US 2007/0137742 A1 Jun. 21, 2007

(30) Foreign Application Priority Data

Dec. 25, 2003 (CN) ..... 2003 1 0119498

(51) Int. Cl.
*C22C 14/00* (2006.01)

(52) U.S. Cl. ..... 420/417; 420/418; 420/419; 148/421

(58) Field of Classification Search ..... None
See application file for complete search history.

(56) References Cited

U.S. PATENT DOCUMENTS 4,857,269 A 8/1989 Wang et al.
5,169,597 A 12/1992 Davidson et al.
5,545,227 A 8/1996 Davidson et al.
5,573,401 A 11/1996 Davidson et al.

(Continued)

FOREIGN PATENT DOCUMENTS

CN 12-10897 A 3/1999

(Continued)

OTHER PUBLICATIONS

International Preliminary Report on Patentability issued in PCT Int. Pat. App. No.: PCT/CN2004/001352 on Jun. 29, 2006 and Int'l Search Reprot for same each in English/.

(Continued)

*Primary Examiner*—George Wyszomierski
(74) *Attorney, Agent, or Firm*—Smith, Gambrell & Russell, LLP

(57) ABSTRACT

The patent provides the titanium alloy with extra-low modulus and superelasticity containing 20~35 wt. % niobium, 2~15 wt. % zirconium, balanced titanium and other unavoidable impurity elements. The advantages of the invention alloy are shown as follows: The invention titanium alloy has superior cold processing capacity and low work hardening rate; It can be severely deformed by cold rolling and cold drawing; It has superelasticity, shape memory effect, damping capacity, low modulus, high strength, good corrosion resistance and high biocompatibility; The invention titanium alloy can be made into nano-size materials by cold deformation and extra high strength can be achieved by heat treatment.

6 Claims, 8 Drawing Sheets

U.S. PATENT DOCUMENTS

| | | | | |
|---|---|---|---|---|
| 5,855,697 | A | 1/1999 | Luo et al. | 148/420 |
| 5,871,595 | A * | 2/1999 | Ahmed et al. | 148/421 |
| 6,319,340 | B1 | 11/2001 | Takeuchi et al. | |
| 6,607,693 | B1 * | 8/2003 | Saito et al. | 420/417 |
| 2003/0102062 | A1 * | 6/2003 | Furuta et al. | 148/671 |
| 2003/0188810 | A1 | 10/2003 | Tanaka et al. | |
| 2005/0072496 | A1 * | 4/2005 | Hwang et al. | 148/421 |

FOREIGN PATENT DOCUMENTS

| | | | |
|---|---|---|---|
| CN | 14-01804 | A | 3/2003 |
| CN | 14-12332 | A | 4/2003 |
| CN | 1570168 | | 1/2005 |
| DE | 1590261 | | 6/1975 |
| JP | 61-159542 | A | 7/1986 |
| JP | 61159542 | | 7/1986 |
| JP | 10-219375 | | 8/1998 |
| JP | 2004/263280 | A | 9/2004 |

OTHER PUBLICATIONS

"Survey of the Mg-Al Based Elevated Temperature Magnesium Casting Alloys"; Materials for Mechanical Engineering; vol. 25, No. 11; Nov. 2001; Liu Zili, et al.—In Chinese w/English Language abstract.

* cited by examiner

TITANIUM ALLOY WITH EXTRA-LOW MODULUS AND SUPERELASTICITY AND ITS PRODUCING METHOD AND PROCESSING THEREOF

FIELD OF THE INVENTION

This invention relates to technique of titanium alloy, especially to the titanium alloy with extra-low modulus and superelasticity and its producing method and processing thereof. In particular, the invention is of the Ti—Nb—Zr. and Ti—Nb—Zr—Sn alloys for biomedical application that have superelasticity, extra-low modulus and good biocompatibility.

BACKGROUND OF THE INVENTION

Titanium alloys have been widely used to replace damaged hard tissue due to their good biochemical compatibility, low density, low modulus, high strength and good corrosion resistance in human body. At present, the α+β type Ti-6Al-4V and Ti-6Al-7Nb are most widely used for medical application as they possess half modulus of stainless steel and cobalt alloys, which can reduce the "stress shielding" effect caused by the great difference in flexibility or stiffness between natural bone and the implant material and decrease the premature failure of the implant. Due to concerns on the release of toxic Al and V during long time implantation, new β type titanium alloys have been developed in the United States and Japan in the 1990's. These alloys include Ti-13Nb-13Zr, Ti-15Mo and Ti-35Nb-5Ta-7Zr developed in the US and Ti-29Nb-13Ta-4.6Zr, Ti-15Sn-4Nb-2Ta and Ti-15Zr-4Nb-4Ta developed in Japan etc. All above alloys have low modulus and high strength. The modulus is greater than 60 GPa in solution treated condition and 80 GPa in ageing condition. All these alloys are mainly used as artificial bone, articulation, dental implant and bone plate that can bear high stress loading.

As to Ti—Nb—Zr systems, there are many inventions about the low modulus medical implant. For example, the titanium alloys consisting of: from 10 to 20 wt. % niobium (U.S. Pat. Nos. 5,545,227; 5,573,401; 5,169,597), from 35 to 50 wt. % niobium (U.S. Pat. No. 5,169,597) and less than 24 wt. % niobium and zirconium (U.S. Pat. No. 4,857,269). All above alloys belong to low modulus implants. However, there is no public report and inventions about the superelasticity of these alloys till now.

TiNi alloys are widely used in clinical fields because of excellent shape memory effect and superelasticity. However, allergic and toxic effects of Ni ions released from TiNi alloy to human body have been pointed out. Consequently, new Ni-free biomaterials has been developed in the middle 1990's, such as Ni-free stainless steel.

The shape memory effect of titanium alloys was first observed in Ti-35 wt. % Nb by Baker (Baker C, Shape memory effect in a titanium-35 wt % niobium alloy, Metal Sci J, 1971; 5: 92). Duerig also observed shape memory effect in Ti-1 OV-2Fe-3AI (Duerig T W, Richter D F,.Albrecht J, Shape memory in Ti-10V-2Fe-3Al, Acta Metall, 1982; 30: 2161). However, the shape memory phenomena of the above titanium alloy can only be observed when this alloy was immersed in quickly-heated salt solution at high temperature. Therefore, these alloys were not further investigated. Recently, a new class of titanium alloys with superelasticity, such as Ti—V—Al, Ti—V—Ga and Ti—V—Ge (U.S. Pat. No. 6,319,340) and Ti—Mo—Al, Ti—Mo—Ga and Ti—Mo—Ge (U.S. Pat. Application No. 20030188810), have been developed in Japan.

During investigation of metastable Beta type titanium alloys, Hao et al. suggested that controlling the grain size and the amount of α phase in alloy is an effective way to produce the low modulus and high strength titanium alloy. (Hao Y L, Niinomi M, Kuroda D, Fukunaga K, Zhou YL, Yang R, Suzuki A, Aging response of the Young's modulus and mechanical properties of Ti-29Nb-13Ta-4.6Zr for biomedical applications, Metall. Mater. Trans. A, 2003; 34: 1007). Therefore, producing bulk nano-size material is the key to resolve the above problem. However, the proper method of fabricating bulk nano-size metals has not been developed in industry up to now, which limited the application of nano-size materials. The investigations on nanomaterials were mainly focused on pure copper, iron, titanium and other structural alloys. Recently, it has been suggested that the nano-size materials can be easily fabricated in metastable metals. Because the metastable materials often possess superelasticity and damping property, they can be used widely.

SUMMARY OF THE INVENTION

The invention provides a novel superelastic, extra-low modulus, shape memory, damping, high strength, good corrosion resistance and high biocompatibility titanium alloy (titanium, niobium and zirconium system) and its fabricating and processing method. The alloys may find wide applications in medical care, sports and industry components.

In order to realize the above destination, the technical program of this invention is as follows:

The extra-low modulus titanium alloy consists of: titanium; from 20 to 35 wt. % niobium, from 2 to 15 zirconium; unavoidable impurities.

The invention titanium alloy contains from 30 to 45 wt. % niobium-and zirconium in total to guarantee the recoverable tensile strain to be above 2%, low modulus less than 60 GPa and high damping property at room temperature and human body temperature.

The invention alloy further comprises at least one component of tin and/or aluminum and the total amount is from 0.1 to 12 wt. %; the total amount of zirconium and tin is from 3 to 20 wt. % to ensure the superelasticity to be over 2%, modulus less than 60 GPa and high damping property at temperature from −80° C. to 100° C.

The invention alloy further comprises at least a kind of interstitial element without toxicity such as C or N and/or O the total amount of which is less than 0.5 wt. %.

The method of fabricating the titanium alloy with extra-low modulus comprises melting in vacuum and heat treatment, wherein the procedure comprises: solution treatment at temperature from 200° C. to 850° C. for from 10 s to 2 h, followed by air cooling or air cooling for from 2s to 60s and then water quenching to improve the superelasticity, damping property and strength; the alloy can be solution treated at temperature from 200° C. to 900° C. followed by water quenching and then aging at temperature from 200° C. to 600° C. for from 10 s to 60 min=followed by air cooling and then water quenching to improve the superelasticity, damping property and strength; otherwise, the invention titanium alloy can be aged at temperature from 200° C. to 600° C. for from 2 min to 48 h to improve the strength while maintaining low modulus.

The processing method of the invention alloy consists of: hot processing, comprising=, hot rolling, hot drawing, hot forging; cold processing, comprising cold rolling, cold drawing, cold swaging. When the cold deformation ratio is below 20%, the Young's modulus is less than 45 GPa; when the cold deformation ratio is above 50%, a nano-size material can be fabricated.

The nano-size materials were solution treated at temperature from 500° C. to 850° C. for from 10 s to 2 h to improve elongation; or aged at temperature from 300° C. to 550° C. for from 10 s to 2 h to improve strength; or solution treated at temperature from 500° C. to 850° C., and then aged at temperature from 300° C. to 550° C. for from 10 s to 2 h to improve the elongation and strength of nano-size materials.

Compared with prior art, the invention has the following advantages:

1. The invention titanium alloy has superior cold processing ability, lower work hardening rate and can be deformed to a large extent through cold working technique, such as cold rolling, cold drawing and so on.
2. The invention titanium alloy has superelasticity, shape memory, damping, low modulus, high strength, good corrosion resistance and biocompatibility.
3. The invention titanium alloy can be made into nano-grained materials through cold working and super-high strength can be achieved by heat treatment.
4. The invention titanium alloy may be widely used in medical, sports and industry fields.

First, the invention alloy can be used for biomedical application due to its low modulus, superelasticity, shape memory effect and good biocompatibility.

1) The invention titanium alloy contains nontoxic elements only and has good biocompatibility. Because of its high strength and low modulus, the invention alloy can be used as hard tissue implant, such as artificial bone, hip joint, dental and bone plate, which can reduce the "stress shielding" effect caused by the great difference between bone and implant and prolong the life of the implant in human body.
2) The invention titanium alloy has superelasticity and shape memory effect and can be used widely as stent and dental arch wire to instead of shape memory TiNi which can bring allergic and toxic effects.
3) The invention titanium alloy has low modulus and superelasticity and can be used as elastic fixer of spinal.
4) The invention nano-size alloy has higher bioactivity surface. The coating with high biocompatibility, such as hydroxyapatite and glass-ceramics, can be formed on such surface, which can improve the bonding strength among the implant, bioactive coating and body tissue.

Moreover, the invention titanium alloy has shape memory effect and superelasticity and can be used as industrial functional materials. For example, the invention alloy can be applied for making frame of glasses by using its superelasticity and can be made into actuator by using its shape memory effect.

Furthermore, the invention alloy has high strength and low modulus and, besides the implant application, the alloy can be used to fabricate structural components with high strength, such as golf club surface materials and springs.

DESCRIPTION OF THE INVENTION IN DETAIL

The following examples are intended to illustrate the invention as described above in detail.

EXAMPLE 1

Figure 1A:
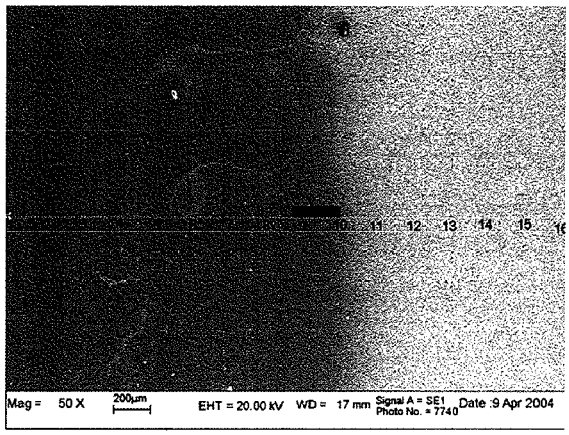
FIG. 1A is SEM morphology of Ti-20Nb-2Zr/Ti-35Nb-2Zr diffusion couple.
Figure 1B:
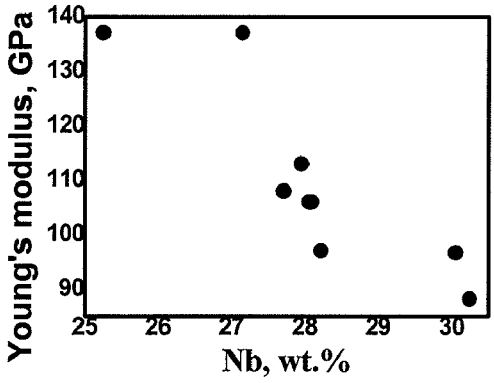
FIG. 1B is EDS analysis results of Ti-20Nb-2Zr/Ti-35Nb-2Zr diffusion couple.

The master alloys listed in Table 1 were melted with a non-consumable arc melting furnace with magnetic agitation. To ensure chemical homogeneity, the buttons with weight of 60 g were melted three times. They were forged at 950° C. to bars with cross-section of 10 mm×10 mm and specimens with dimension of 20×6×4 mm were cut. After grinding and polishing, they were diffusion-coupled at 1000° C. for 4 h in. vacuum according to chemical composition listed in Table 1. These couples were heat-treated at 1300° C. for 50 h to obtain diffusion coupled with thickness of more than 1 mm. FIGS. 1A and 1B shown SEM photograph and EDS analysis results of Ti-20Nb-5Zr/Ti-35Nb-5Zr diffusion couple.

TABLE 1

| Chemical composition of Ti—Nb—Zr/Ti—Nb—Zr and Ti—Nb—Zr—Sn/Ti—Nb—Zr—Sn diffusion couples (wt. %). | | |
|---|---|---|
| Ti-20Nb-2Zr/Ti-35Nb-2Zr | Ti-20Nb-5Zr/Ti-35Nb-5Zr | Ti-20Nb-8Zr/Ti-35Nb-8Zr |
| Ti-20Nb-4Zr -2Sn/ Ti-35Nb-4Zr -2Sn | Ti-20Nb-4Zr -5Sn/ Ti-35Nb-4Zr -5Sn | Ti-20Nb-4Zr-8Sn/ Ti-35Nb-4Zr -8Sn |
| Ti-20Nb-8Zr -2Sn/ Ti-35Nb-8Zr -2Sn | Ti-20Nb-8Zr -5Sn/ Ti-35Nb-8Zr -5Sn | Ti-20Nb-8Zr-8Sn/ Ti-35Nb-8Zr -8Sn |
| Ti-20Nb-12Zr -2Sn/ Ti-35Nb-12Zr -2Sn | Ti-20Nb-12Zr -5Sn/ Ti-35Nb-12Zr -5Sn | Ti-20Nb-12Zr-8Sn/ Ti-35Nb-12Zr -8Sn |

Figure 1C:
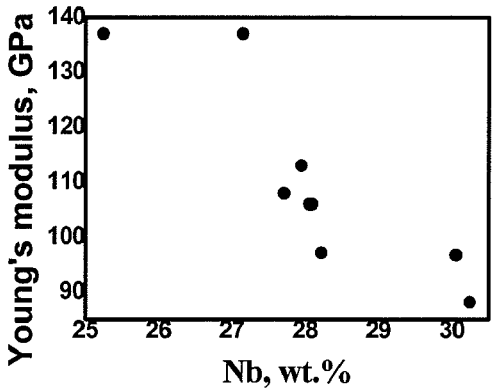
FIG. 1C is Young's modulus of Ti-20Nb-2Zr/Ti-35Nb-2Zr diffusion couple.

After grinding and polishing, indentation technique was used to study the elastic recovery, elastic modulus and hardness during loading and unloading and to establish the relations among chemical composition, elastic modulus and hardness. For example, variation of Young's modulus with chemical composition of Ti-20Nb-5Zr/Ti-35Nb-5Zr diffusion couple was given in FIG. 1C.

Figure 2:
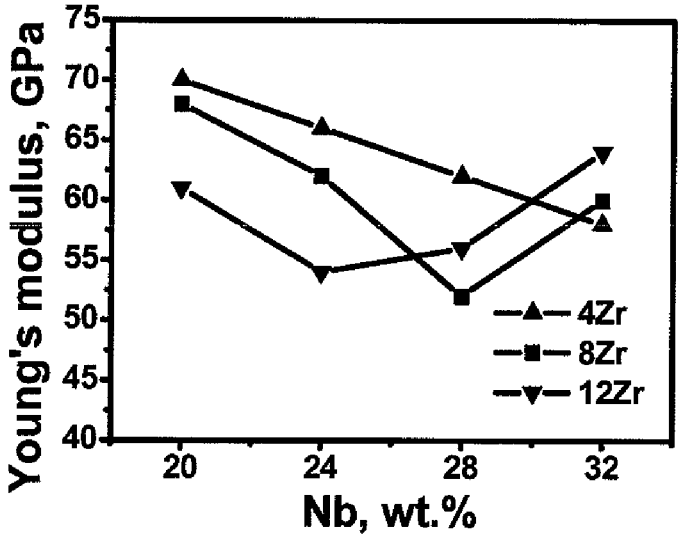
FIG. 2 is Young's modulus of Ti—Nb—Zr ternary alloys.
Figure 3:
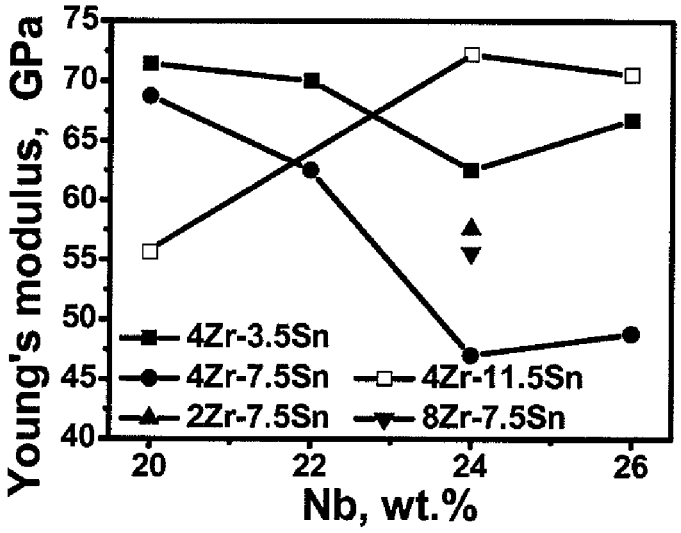
FIG. 3 is Young's modulus of Ti—Nb—Zr —Sn quaternary alloys.

Based on the above experimental results, chemical composition range with low elastic modulus can be determined. The alloys shown in FIGS. 2 and 3 were melted three times with a non-consumable arc melting furnace with magnetic agitation. The melted buttons weighing 60 g were forged at 950° C. to bars 10×10 mm in cross-section. Then the samples were encapsulated in quartz tubes and were solution-treated at 850° C. for 30 min and then air cooled for 20 s followed by quenching in water after breaking. Tensile testing was conducted by tensile test at initial strain rate of $1\times10^{-3}$ $s^{-1}$ using specimen with gauge section of 3 mm in diameter and 15 mm in length. In order to measure Young's modulus accurately, recovered strains were determined through stress-strain curves recorded by strain gauge. The results are shown in FIGS. 2 and 3 for ternary Ti—Nb—Zr and quaternary Ti—Nb—Zr—Sn alloys, respectively. The results shows that Young's modulus can be decreased by controlling chemical compositions of Nb, Zr, Sn.

EXAMPLE 2

Differences from Example 1 are as follows. This example is to investigate the effect of alloying on α" martensite starting transformation temperature and to identify chemical composition range that exhibits high recoverable strain.

The alloys were melted three times with a non-consumable arc melting furnace with magnetic agitation. The nominal chemical compositions of alloys are listed in Table 2. The melted buttons weighing 60 g were forged at 950° C. to bars 10×10 mm in cross-section. Then the samples were encapsulated in quartz tubes and were solution-treated at 850° C. for 30 min and then air cooled for 20 s followed by quenching in water after breaking. The transformation temperature of martensite to autenite was measured by differential scanning calorimetry (DSC) at heating or cooling rate of 10° C. per minute during the temperature range from −150° C. to 150° C. The results in Table 3 shown that the transformation temperature decreased by about 17.6° C., 41.2° C. and 40.9° C. with the change of 1 wt. % Nb, Zr and Sn, respectively.

TABLE 2

| Chemical composition of quaternary Ti—Nb—Zr—Sn alloys (wt. %) | | | | | | |
|---|---|---|---|---|---|---|
| | 20Nb | 22Nb | 24Nb | 26Nb | 28Nb | 32Nb |
| 2Zr-8Sn | ✓ | ✓ | ✓ | ✓ | ✓ | ✓ |
| 4Zr-4Sn | ✓ | ✓ | ✓ | ✓ | ✓ | ✓ |
| 4Zr-8Sn | ✓ | ✓ | ✓ | ✓ | x | ✓ |
| 4Zr-12Sn | ✓ | ✓ | ✓ | x | x | x |
| 6Zr-2Sn | x | x | x | ✓ | ✓ | ✓ |
| 8Zr-2Sn | x | ✓ | ✓ | ✓ | x | x |
| 8Zr-8Sn | ✓ | ✓ | x | x | x | ✓ |

TABLE 3

| Effect of alloying on α" starting transformation temperature | | | |
|---|---|---|---|
| | 1 wt. % Nb | 1 wt. % Zr | 1 wt. % Sn |
| $M_s$(° C.) | −17.6° C. | −41.2° C. | −40.9° C. |

Figure 4A:
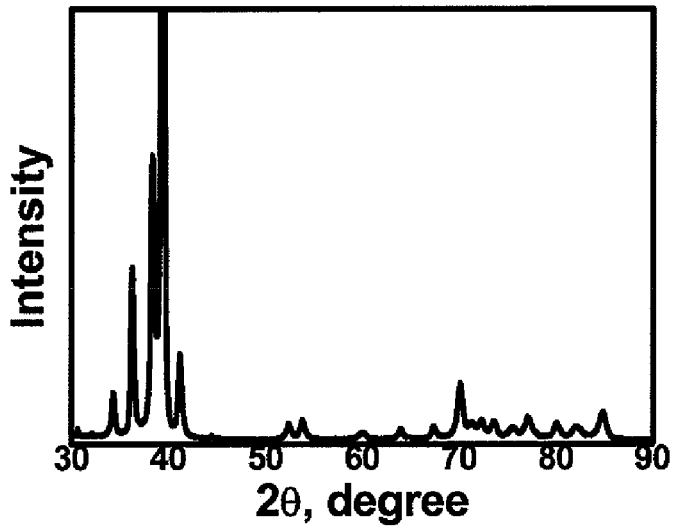
FIG. 4A is X-ray diffraction profiles of Ti-28Nb-2Zr-8Sn alloy.
Figure 4B:
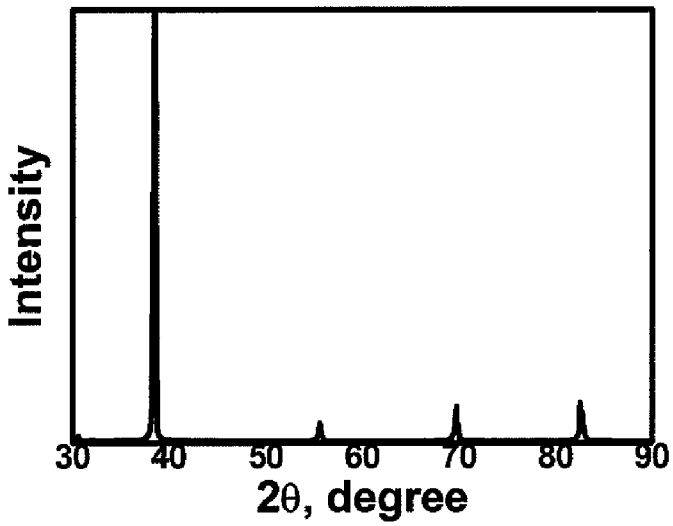
FIG. 4B is X-ray diffraction profiles of Ti-32Nb-8Zr-8Sn alloy.
Figure 5:
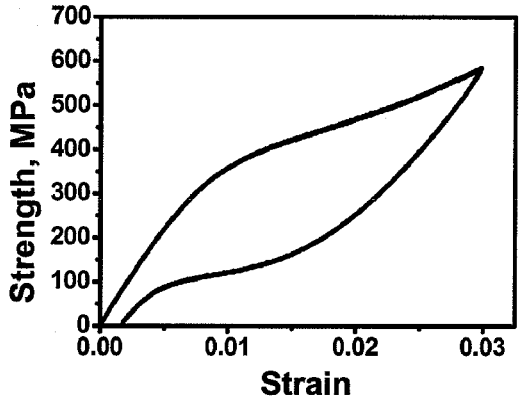
FIG. 5 is a stress-strain curve of Ti-30Nb-10Zr alloy under loading and unloading.
Figure 6:
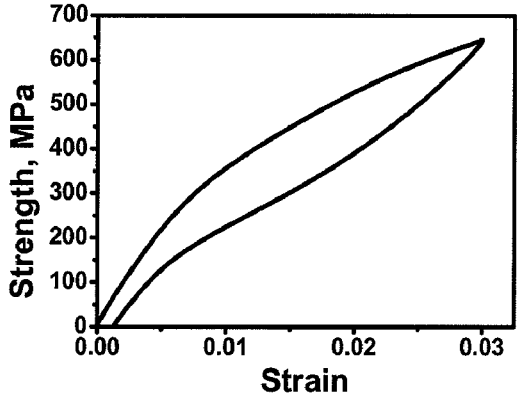
FIG. 6 is a stress-strain curve of Ti-28Nb-15Zr alloy under loading and unloading.
Figure 7:
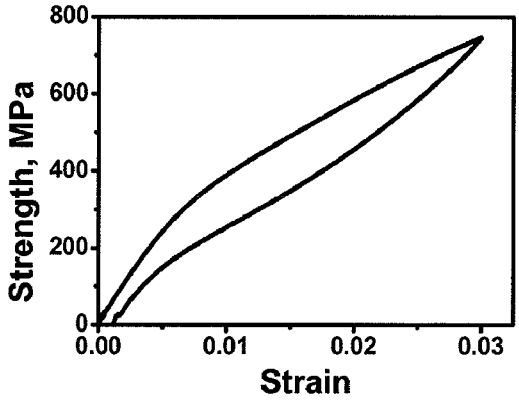
FIG. 7 is a stress-strain curve of Ti-28Nb-8Zr-2Sn alloy under loading and unloading.
Figure 8:
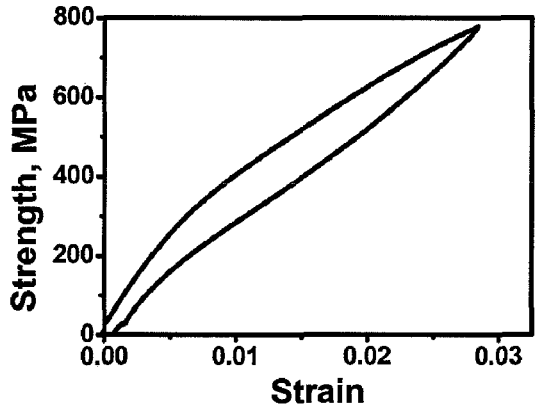
FIG. 8 is a stress-strain curve of Ti-24Nb-4Zr-7.9Sn alloy under loading and unloading.
Figure 9:
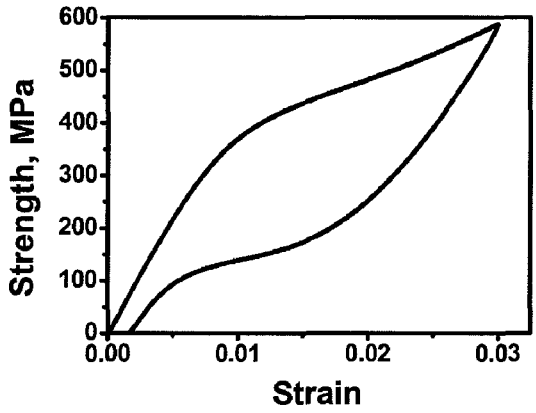
FIG. 9 is a stress-strain curve of Ti-20Nb-4Zr-12Sn alloy under loading and unloading.

Phase constitutions and their lattice parameters in as-quenched specimens were determined by 2θ/θ coupling method of X-ray diffraction analysis along the transverse direction of specimens after polishing and heavy etching to remove internal stress. In order to increase accuracy of lattice parameter measurement, a low scanning speed of 1 degree per minute was adopted under the condition of 2θ between 30 and 90 degrees. The X-ray diffraction profiles of Ti-28Nb-2Zr-8Sn and Ti-32Nb-8Zr-8Sn were shown in FIGS. 4A and 4B.

Based on the results of the effect of composition on α" martensite transformation temperature, the Ti—Nb—Zr and Ti—Nb—Zr—Sn alloys (Ti-30Nb-10Zr; Ti-28Nb-15Zr; Ti-28Nb-8Zr-2Sn; Ti-24Nb-4Zr-7.9Sn; Ti-20Nb-4Zr-12Sn in particular ) with α" martensite starting transformation temperature ($M_s$) below 0° C. (FIGS. 5 to 9) were melted three times with a non-consumable arc melting furnace with magnetic agitation. The melted buttons weighing 60 g were forged at 950° C. to bars 10×10 mm in cross-section. Then the samples were encapsuled in quartz tubes. Then the sealed samples were solid solution-treated at 850° C. for 30 min and air cooled for 20 s followed by quenching in water after breaking. Tensile testing was conducted by cyclic deformation at initial strain rate of $1\times10^{-3}$ $S^{-1}$ using specimen with gauge section of 3 mm in diameter and 15 mm in length. In order to evaluate superelasticity accurately, recovered strains were determined through stress-strain curves recorded by strain gauge. For example, FIG. 5~FIG. 9 shown that ternary Ti—Nb—Zr and quaternary Ti—Nb—Zr—Sn alloys have good superelasticity and low Young's modulus of from about 40 GPa to 50 GPa, which was only 35%~45% of that of Ti-6Al-4V, Ti-6Al-7Nb and Ti-5Al-2.5 Fe biomedical titanium alloys.

EXAMPLE 3

Figure 10:
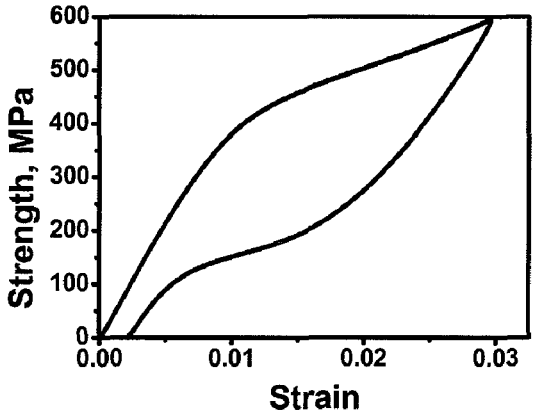
FIG. 10 is a stress-strain curve of Ti-28Nb-2Zr-6Sn-2Al alloy under loading and unloading.

Ti-28Nb-2Zr-6Sn-2Al ingot with weight of 60 g was melted.three times with a non-consumable arc melting furnace with magnetic agitation. The melted buttons were forged at 950° C. to bars 10×10 mm in cross-section. Then the samples were encapsulated in quartz tubes. Then the sample was solution-treated at 850° C. for 30 min and air cooled for 20 s followed by quenching in water after breaking. The loading-unloading curve in FIG. 10 shown that the alloy with Al addition also has low modulus and good superelasticity.

EXAMPLE 4

Based on Examples 1 and 2, the chemical compositions of alloys can be determined having low elastic modulus and high recoverable tensile strain. An example of Ti-24Nb-4Zr-7.9Sn alloy was given in the following to show the effect of working processes and heat treatments on mechanical properties.

The Ti-24Nb-4Zr-7.9Sn ingot with 30 kg weight was melted for three times by vacuum arc. The ingot was forged at 850 °C. to a bar with diameter of 20 mm and then hot rolled to rods of 10 mm in diameter.

The rods of 10 mm in diameter were solution-treated according to Table 4 and then air cooled for 20 s followed by quenching in water. Then samples with gauge section of 3 mm in diameter and 15 mm in length were machined and ground after heat treatment, and used to measure loading-unloading curve at strain rate of $1\times10^{-3}$ $s^{-1}$ in the strain range 3%. In order to evaluate superelasticity and Young's modulus accurately, stress-strain curves were recorded by strain gauge. It can be seen form Table 4 that the Ti-24Nb-4Zr-7.9Sn alloy has low modulus and good superelasticity in a wide range of heat treatment temperature and time.

TABLE 4

Elastic modulus and superelasticity of Ti—24Nb—4Zr—7.9Sn alloy

| Heat treatment | Young's modulus (GPa) | Superelasticity (%) |
|---|---|---|
| As hot-rolled | 42 | 2.8 |
| 900° C. for 60 min | 44 | 2.7 |
| 850° C. for 30 min | 44 | 2.9 |
| 850° C. for 60 min | 42 | 2.8 |
| 850° C. for 90 min | 45 | 2.8 |
| 700° C. for 30 min | 41 | 2.9 |
| 700° C. for 60 min | 43 | 2.8 |
| 650° C. for 30 min | 46 | 2.6 |
| 650° C. for 60 min | 47 | 2.5 |
| 600° C. for 60 min | 54 | 2.2 |
| 500° C. for 10 min | 48 | 2.9 |
| 500° C. for 20 min | 54 | 2.2 |
| 500° C. for 30 min | 58 | 1.9 |
| 450° C. for 10 min | 50 | 2.9 |
| 450° C. for 30 min | 54 | 2.5 |
| 400° C. for 10 min | 46 | 2.9 |
| 300° C. for 10 min | 44 | 2.9 |
| 850° C. for 30 min +500° C. for 10 min | 45 | 2.8 |
| 850° C. for 30 min +450° C. for 10 min | 50 | 2.8 |

Note:
For the two-step heat treatments, specimens were air-cooled for 20 s and then quenched in water after both solution treatment ageing treatments at 500° C. and 450° C. for 10 min.

Rods with a diameter of 10 mm were solution-treated according to the temperature and time shown in Table 5 followed by air cooling only. The samples with gauge section of 3 mm in diameter and 15 mm in length were machined after heat treatment, and then used to measure loading-unloading curve at strain rate of $1\times10^{-3}$ $s^{-1}$ during the strain range below 3%. In order to evaluate superelasticity and Young's modulus accurately, stress-strain curves were recorded by strain gauge. It can be seen from Table 5 that the air cooled samples also possess superelasticity and low Young's modulus whereas the superelasticity was lower than those listed in Table 4 by air cooling 20 s followed by water quenching.

TABLE 5

Elastic modulus and superelasticity of Ti—24Nb—4Zr—7.9Sn alloy

| Heat treatment | Young's modulus (GPa) | Superelasticity (%) |
|---|---|---|
| As hot-rolled | 42 | 2.8 |
| 850° C. for 30 min | 48 | 2.5 |
| 850° C. for 60 min | 50 | 2.5 |
| 850° C. for 90 min | 47 | 2.6 |
| 500° C. for 10 min | 48 | 2.7 |

Figure 11:
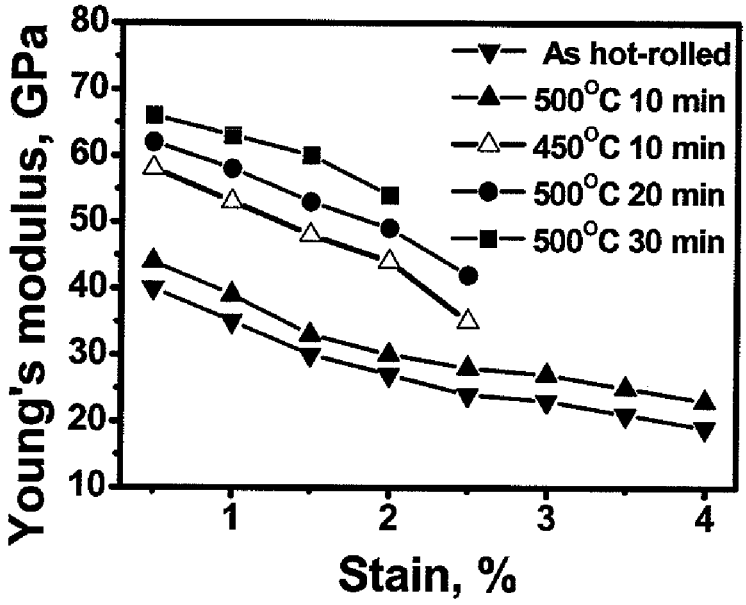
FIG. 11 is an average Young's modulus of Ti-24Nb-4Zr-7.9Sn alloy varying with strain.

The average Young's modulus of these alloys at initial stage of tensile tests was much lower as seen from table 4 and 5. The minimum average Young's modulus of Ti-24Nb-4Zr-7.9Sn after several typical heat treatments was about 20 GPa (FIG. 11).

Rods with a diameter of 10 mm were heat treated according to the temperature and time shown in table 6 and then followed by air cooling. The samples with gauge section of 3 mm in diameter and 15 mm in length were machined after heat treatment, and then used to measure loading-unloading curve at strain rate of $1\times10^{-3}$ $s^{-1}$. In order to evaluate Young's modulus accurately, stress-strain curves were recorded by strain gauge. It can be seen from Table 6 that for the invention alloy, tensile strength greater than 1000 MPa and Young's modulus lower than 70 GPa can be achieved. When the tensile strength is lower than 1000 MPa, the Young's modulus is from 40 to 50 GPa.

TABLE 6

Mechanical properties of Ti—24Nb—4Zr—7.9Sn alloy at room temperature

| Heat treatment | Young's modulus (GPa) | Tensile strength (MPa) | Elongation (%) |
|---|---|---|---|
| As hot-rolled | 42 | 850 | 24 |
| 850° C. for 30 min | 44 | 750 | 29 |
| 850° C. for 60 min | 42 | 740 | 28 |
| 700° C. for 30 min | 41 | 750 | 29 |
| 650° C. for 30 min | 46 | 820 | 25 |
| 650° C. for 60 min | 47 | 830 | 25 |
| 500° C. for 10 min | 48 | 950 | 20 |
| 500° C. for 30 min | 58 | 1040 | 16 |
| 500° C. for 60 min | 60 | 1140 | 15 |
| 450° C. for 240 min | 70 | 1250 | 14 |
| 450° C. for 480 min | 70 | 1200 | 14 |

Note:
The specimens aged at 450° C. for 240 min and 480 min were air-cooled.

EXAMPLE 5

Based on Examples 1 and 2, the chemical compositions of alloys can be determined having low elastic modulus and high recoverable tensile strain. An example of Ti-24Nb-4Zr-7.6Sn alloy was given in the following to show the effect of working processes and heat treatments on mechanical properties.

The Ti-24Nb-4Zr-7.6Sn ingot with weight of 30 kg was melted for three times by vacuum arc. The ingot was forged at 850° C. to bars with diameter of 20 mm and then hot rolled to rods of 10 mm in diameter at 800° C.

Rods with a diameter of 10 mm were heat treated according to the scheme listed in Table 7 followed by air cooling for 20 s and then quenching into water. The samples with gauge section of 3 mm in diameter and 15 mm in length were machined after heat treatment, and then used to measure loading-unloading curve at strain rate of $1\times10^{-3}$ $S^{-1}$ with strains up to 3%. In order to evaluate Young's modulus and superelasticity accurately, stress-strain curves were recorded by strain gauge. The results are listed in Table 7.

TABLE 7

Elastic modulus and superelasticity of Ti—24Nb—4Zr—7.6Sn alloy

| Heat treatment | Young's modulus (GPa) | Superelasticity (%) |
|---|---|---|
| As hot-rolled | 44 | 2.8 |
| 900° C. for 60 min | 44 | 2.6 |
| 850° C. for 30 min | 44 | 2.8 |
| 850° C. for 60 min | 46 | 2.8 |
| 850° C. for 90 min | 45 | 2.8 |
| 750° C. for 60 min | 44 | 2.8 |
| 700° C. for 30 min | 44 | 2.8 |
| 700° C. for 60 min | 41 | 2.9 |
| 600° C. for 60 min | 48 | 2.6 |
| 600° C. for 30 min | 50 | 2.2 |
| 550° C. for 30 min | 60 | 1.8 |
| 500° C. for 10 min | 50 | 2.9 |
| 500° C. for 30 min | 60 | 2.0 |
| 850° C. for 30 min + 500° C. for 10 min | 47 | 2.8 |
| 850° C. for 30 min + 450° C. for 10 min | 51 | 2.7 |

Rods with a diameter of 10 mm were heat treated and then followed by air cooling (Table 8). The sample with gauge section of 3 mm in diameter and 15 mm in length were machined after heat treatment, and then used to measure loading-unloading curve at strain rate of $1\times10^{-3}$ $s^{-1}$ during the strain range below 3%. In order to evaluate Young's modulus accurately, stress-strain curves were recorded by strain gauge. The results are listed in Table 8.

TABLE 8

Elastic modulus and superelasticity of Ti—24Nb—4Zr—7.6Sn alloy

| Heat treatment | Young's modulus (GPa) | Superelasticity (%) |
|---|---|---|
| As hot-rolled | 44 | 2.8 |
| 850° C. for 30 min | 48 | 2.5 |
| 850° C. for 60 min | 50 | 2.5 |
| 850° C. for 90 min | 47 | 2.6 |
| 500° C. for 10 min | 48 | 2.7 |

Rods with a diameter of 10 mm were heat treated according to the temperature and time shown in Table 9. The samples with gauge section of 3 mm in diameter and 15 mm in length were machined after heat treatment, and then used to measure loading-unloading curve at strain rate of $1\times10^{-3}$ $s^{-1}$. In order to evaluate Young's modulus accurately, stress-strain curves were recorded by strain gauge. The results are shown in Table 9.

TABLE 9

Mechanical properties of Ti—24Nb—4Zr-7.6n alloy at room temperature

| Heat treatment | Young's modulus (GPa) | Tensile strength (MPa) | Elongation (%) |
|---|---|---|---|
| As hot-rolled | 44 | 850 | 28 |
| 850° C. for 30 min | 44 | 720 | 33 |
| 850° C. for 60 min | 46 | 740 | 35 |
| 700° C. for 30 min | 41 | 750 | 29 |
| 650° C. for 30 min | 44 | 790 | 31 |
| 500° C. for 10 min | 50 | 980 | 24 |
| 500° C. for 30 min | 57 | 1120 | 20 |
| 500° C. for 60 min | 62 | 1240 | 19 |
| 450° C. for 240 min | 72 | 1320 | 17 |
| 450° C. for 480 min | 74 | 1260 | 18 |

Note:
The specimens aged at 450° C. for 240 min and 480 min were air-cooled.

EXAMPLE 6

Effects of oxygen on Young's modulus and superelasticity of the Ti-24Nb-4Zr-7.9Sn were investigated by the addition of $TiO_2$. The Ti-24Nb-4Zr-7.9Sn ingots weighing 60 g were melted for three times with a non-consumable vacuum melting furnace to insure homogeneous chemical composition. The melted ingot was forged at 950° C. to bars 10×10 mm in cross-section. Then sample with gauge section of 3 mm in diameter and 15 mm in length were machined and then used to measure loading-unloading curve at strain rate of $1\times10^{-3}$ $s^{-1}$ in the strain range up to 3%. In order to evaluate superelasticity and young's modulus accurately, stress-strain curves were recorded by strain gauge. The results are shown in Table 10.

TABLE 10

Effect of oxygen content on Young's modulus and superelasticity of Ti—24Nb—4Zr—7.9Sn alloy

| Oxygen (wt. %) | Young's modulus (GPa) | Superelasticity (%) |
|---|---|---|
| 0.11 | 42 | 2.8 |
| 0.24 | 48 | 2.5 |
| 0.42 | 56 | 2.0 |

EXAMPLE 7

After 2% strain loading-unloading at room temperature, the stress-strain curve of the hot rolled Ti-24Nb-4Zr-7.9Sn shown in example 4 is in a shape of closed loop. The absorbed energy is 0.42 MJ $m^{3}$, corresponding to 6% of mechanical energy. The absorbed ratio is 25 percent of polypropylene and nylon, indicating that Ti-24Nb-4Zr-7.9Sn is a good damping metal material. Because the strength at 2% strain is 565 MPa, the material can be used at high strength condition with good damping properties.

After 2% strain loading-unloading at room temperature, the shape of the stress-strain curve of the hot rolled Ti-24Nb-4Zr-7.6Sn shown in example 5 is a closed loop. The absorbed energy is 0.48 MJ $m^3$, corresponding to 6.5% of mechanical energy.

EXAMPLE 8

Figure 12:
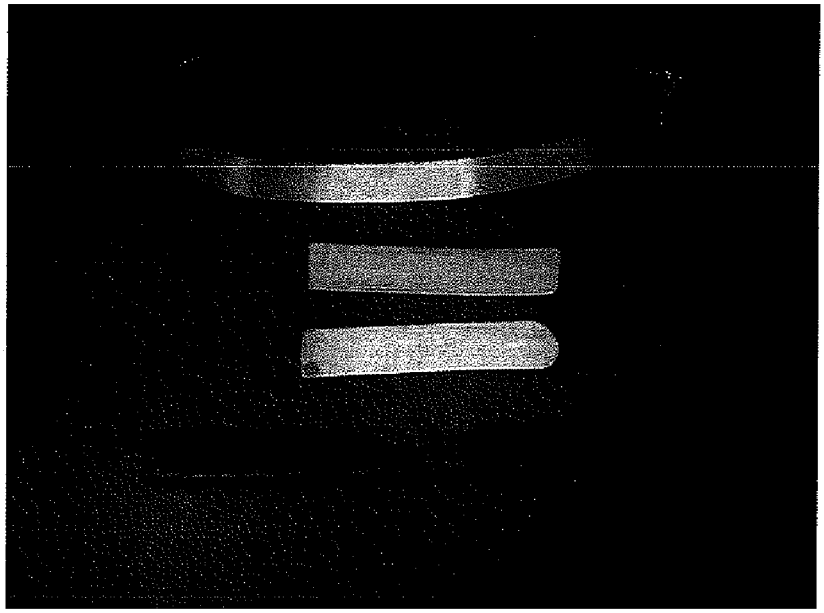
FIG. 12 is a photograph of cold rolled Ti—Nb—Zr—Sn plate and sheet.

The Ti-24Nb-4Zr-7.9Sn and Ti-24Nb-4Zr-7.6Sn alloys described in Example 4 and 5 were hot forged at 850° C. to billet 15 mm in thickness and then cold rolled to plates and sheets with thickness of 3 mm, 1 mm and 0.3 mm without intermediate annealing. The deformation rate is 80%, 90% and 98% respectively (FIG. 12). The strength of sheets after 90% cold rolling is only 60 MPa higher than that of the billet, which indicates that the material has lower work hardening rate.

Figure 13:
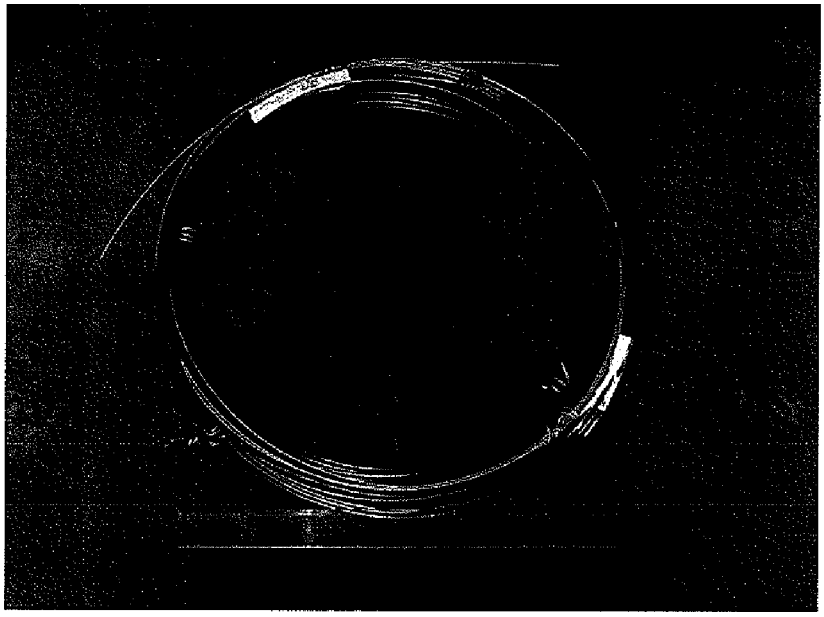
FIG. 13 is a photograph of cold drawing Ti—Nb—Zr—Sn wire.

The rods 10 mm in diameter shown in example 4 and 5 were hot rolled with several passes hot drawing at 700 °C. to rod with diameter of 5 mm. The thin rod was cold drawn to wire with diameter of 3.0 mm and 2.5 mm without intermediate annealing (FIG. 13). The total deformation rate is about 60% and 75%, respectively.

EXAMPLE 9

Effects of pre-straining on the Young's modulus of the alloy in Example 2 and 3, from FIG. 5 to FIG. 10, were investigated using the loading-unloading deformation method. The results were shown in Table 11.

TABLE 11

Effect of pre-straining on Young's modulus

| Chemical composition | Pre-straining (%) | | | |
|---|---|---|---|---|
| (wt. %) | 0 | 3 | 5 | 12 |
| Ti—30Nb—10Zr | 45 GPa | 35 GPa | 24 GPa | 28 GPa |
| Ti—28Nb—15Zr | 46 GPa | 34 GPa | 23 GPa | 31 GPa |
| Ti—30Nb—8Zr—2Sn | 44 GPa | 32 GPa | 24 GPa | 34 GPa |
| Ti—24Nb—4Zr—7.9Sn | 42 GPa | 31 GPa | 21 GPa | 35 GPa |
| Ti—20Nb—4Zr—12Sn | 46 GPa | 34 GPa | 26 GPa | 34 GPa |
| Ti—28Nb—2Zr—6Sn—2Al | 45 GPa | 30 GPa | 21 GPa | 33 GPa |

EXAMPLE 10

Figure 14A:
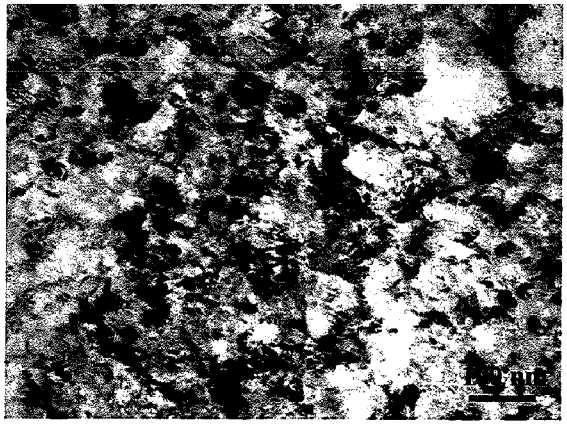
FIG. 14A is a bright field TEM image of Ti-24Nb-4Zr-7.9Sn alloy.
Figure 14B:
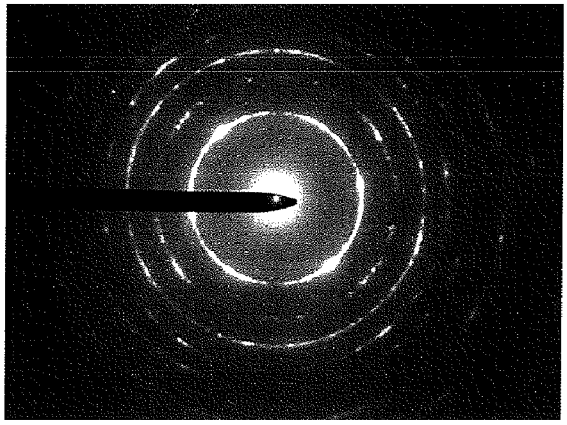
FIG. 14B is a SAD pattern of cold rolled of Ti-24Nb-4Zr-7.9Sn alloy.

The grain size of the cold rolled Ti-24Nb-4Zr-7.9Sn and Ti-24Nb-4Zr-7.6Sn sheets were investigated by TEM. The results showed that the grain size is 120 nm, 50 nm and 20 nm in the sheets with thickness reduction of 80%, 90% and 98% respectively. For example, the bright field TEM image and SAD pattern of Ti-24Nb-4Zr-7.9Sn sheet with 1.5 mm in thickness (90% cold rolling deformation ratio) indicated that the grain size in this alloy is less than 50 nm (FIG. 14A and FIG. 14B).

Figure 15:
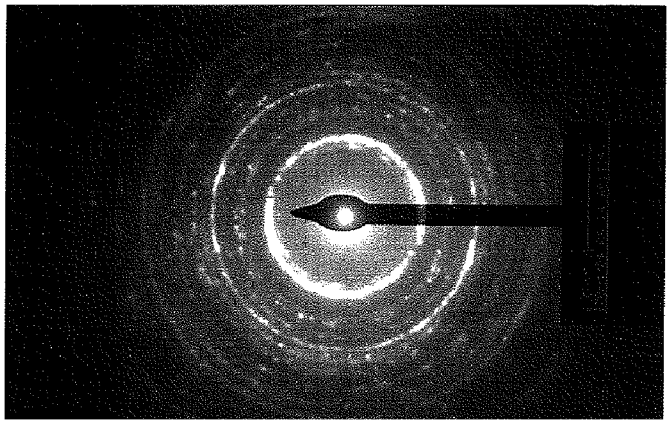
FIG. 15 is a SAD pattern of cold rolled Ti-24Nb-4Zr-7.9Sn with the size of 1.5 mm aged at 500° C. for 1 h.

The nano-size cold rolled sheets consist of both β and α phases after ageing treatment. The SAD pattern of Ti-24Nb4Zr-7.9Sn sheet after ageing at 500° C. for 1 h indicates that both the β and α phases are in nano size (FIG. 15). The results of X-ray analysis shown that the size of β and α phase is about 10 nm.

After ageing at 350° C., 450° C. and 500° C. for 4 h, the strength of nano-size Ti-24Nb-4Zr-7.9Sn and Ti-24Nb-4Zr-7.6Sn cold rolled sheets with thickness of 1.5 mm are higher than 1600 MPa and the Young's modulus is lower than 90 GPa.

After ageing at 550° C., 650° C. and 750° C. for 10 min and 90 min, the elongation of nano-size Ti-24Nb-4Zr-7.9Sn and Ti-24Nb-4Zr-7.6Sn sheet at room temperature are higher than 10%. The grain size of nano-size plate with thickness of 0.45 mm is about 400 nm after solution treatment at 650° C. for 60 min and 15 nm after solution treatment at 500° C. for 60 min. The results indicated that the nano-size material has stable morphology at high temperature. The material has higher morphology stability than that of nano-size copper and iron under high temperature condition.

After solid solution treated at 600° C. for 1 min air cooled and then aged at 450° C. for 4 h air cooled, the strength of nano-size Ti-24Nb-4Zr-7.9Sn and Ti-24Nb-4Zr-7.6Sn plate with thickness of 1.5 mm is 1540 MPa and 1520 MPa, the elongation is higher than 3%.

What is claimed is:

1. A titanium alloy with extra-low modulus and superelasticity, wherein the titanium alloy is a ternary alloy of Ti/Nb/Zr, a quaternary alloy of Ti/Nb/Zr and one of Sn or Al, or a quinary alloy of Ti/Nb/Zr/Sn/Al, and wherein said titanium alloy comprises:

28 wt % >niobium≧20 wt %, and

2~5 wt % zirconium.

2. The titanium alloy of claim 1, wherein the alloy further comprises at least one interstitial element without toxicity selected from C or N or O with amount of less than 0.5 wt %.

3. The titanium alloy of claim 1, wherein the alloy includes-unavoidable impurity elements.

4. The alloy of claim 1, wherein the alloy is the quaternary alloy and includes 26 wt %>niobium≧22 wt %, 8 wt %≧zirconium≧2 wt % and 12 wt %≧tin≧2wt %.

5. The titanium alloy of claim 4, wherein the alloy includes unavoidable impurity element.

6. The titanium alloy of claim 4, wherein the alloy further comprises at least one interstitial element selected from C, N or O with an amount of less than 0.5 wt %.

* * * * *